United States Patent [19]

Rolle

[11] Patent Number: 4,703,528

[45] Date of Patent: Nov. 3, 1987

[54] GROUND COVER AND COVERLET

[76] Inventor: Reno R. Rolle, 1509-B Burlington-Mt. Holly Rd., Burlington, N.J. 08016

[21] Appl. No.: 893,869

[22] Filed: Aug. 6, 1986

[51] Int. Cl.[4] ..... A47G 9/06

[52] U.S. Cl. ..... 5/417; 5/502; 190/2

[58] Field of Search ..... 5/417–420, 5/500, 502, 482; 190/2; 383/4

[56] References Cited

U.S. PATENT DOCUMENTS

| | | | |
|---|---|---|---|
| D. 258,035 | 1/1981 | Fenwick | 5/417 |
| 2,264,471 | 12/1941 | Glenn | 5/419 |
| 2,809,006 | 10/1957 | Jansey | 5/417 |
| 2,853,399 | 9/1958 | Shoults | 154/49 |
| 2,907,057 | 10/1959 | Specht | 5/417 |
| 2,939,468 | 6/1960 | Boyce | 5/417 |
| 3,082,437 | 3/1963 | Uptmagrove | 5/419 |
| 3,226,737 | 1/1966 | Rote | 5/417 |
| 3,669,817 | 6/1972 | McDevitt | 5/417 |
| 4,097,944 | 7/1978 | Yulish | 5/419 |
| 4,223,056 | 9/1980 | DiFronzo | 5/417 |
| 4,231,125 | 11/1980 | Tittl | 5/419 |
| 4,468,823 | 9/1984 | Tounjian | 5/417 |
| 4,546,507 | 10/1985 | Weinstein | 5/417 |
| 4,634,618 | 1/1987 | Greer et al. | 5/417 |
| 4,654,906 | 4/1987 | Roberts | 5/417 |

FOREIGN PATENT DOCUMENTS

| | | | |
|---|---|---|---|
| 2402335 | 8/1974 | Fed. Rep. of Germany | 5/417 |
| 2400873 | 4/1979 | France | 5/417 |
| 2431271 | 3/1980 | France | 5/417 |
| 2540366 | 8/1984 | France | 5/417 |
| 244177 | 12/1925 | United Kingdom | 5/417 |

*Primary Examiner*—Alexander Grosz

*Attorney, Agent, or Firm*—Thomas A. Lennox

[57] ABSTRACT

A coverlet suitable for placing on the beach or ground or use as a bed cover, includes two plies, one of cotton terry cloth and the bottom ply of cotton twill cloth. The corner reinforcements with holes allow each coverlet to be interconnected with clips to form larger shapes with a hidden pocket opening to an edge of the coverlet closed by VELCRO strips, supplied in a waterproof bag constructed of waterproof fabric with a draw string closure, shoulder carrying strap and patch pocket closed with VELCRO.

8 Claims, 9 Drawing Figures

GROUND COVER AND COVERLET

BACKGROUND OF THE INVENTION

This invention relates to a ground cover suitable for persons to sit on or lie on the ground. This cover is particularly suitable for use on the beach where persons are swimming in the water and then returning to sit or lie on the ground cover.

The types of ocean front properties vary widely from broad sandy beaches to small pebbles and even to large rocks. Ground covers used for these types of beaches vary widely and the most common is the standard "beach towel" which is merely a large terry cloth towel large enough for persons to sit or lie on and avoid direct contact with the sand or pebbles or rock of the beach. If the beach surface is sand, the terry cloth quickly becomes wet and when a person sits on it, the sand or soil beneath the terry cloth becomes adhered to the back. This soils the cloth or at least causes substantial discomfort to any person lying on the towel after it has become wet and soiled. Further, terry cloth provides insufficient protection and comfort when the beach is composed of small pebbles or stones. Terry cloth, particularly when it is wet does not provide a comfortable cover for the ground. Terry cloth is even less suitable if the beach is composed of large rocks.

On the other hand, a nonporous cover such as vinyl plastic, plasticized to make it flexible is again not suitable. Plasticized polyvinyl chloride, even reinforced with fabric, provides no "breathing" and tends to trap moisture both above and below the layer. On a warm day, the person lying on a nonbreathing surface will suffer great discomfort due to the accumulation of moisture and heat between the body and the plastic surface. Further, moisture will accumulate on the bottom surface of the plastic surface giving it a cold and "clammy" feeling. Even multiple ply constructions using a moisture trapping surface such as the plasticized polyvinyl chloride film suffers from the same difficulties, even if it is fixed to a porous fabric ply. While vinyl film provides protection in colder whether, it is not "comfortable" to the touch and becomes uncomfortable again, during use, due to entrapment of moisture. Vinyl film, even when it is reinforced with fabric, is easily punctured and torn by sharp objects found on the ocean beaches and is particularly not suitable for rocky surfaces.

An additional difficulty on beaches is that the breeze or wind tends to lift the corners of the cover causing items resting on the cover to be lost. The breeze tends to overturn the cover bringing the top surface in contact with the ground, causing it to pick up sand or dirt to the great discomfort of the user. Prior devices have used pegs to hold down the corners, but these are extremely dangerous to persons stepping on or tripping over these pegs.

Pockets have been provided in beach towels to hide the persons belongings while the owner is swimming or away from the cover. These covers have utilized openings where the pocket opens below the towel into a hole beneath the towel. This is uncomfortable and not practical in most locations.

The above needs have not been satisfied by the covers in the prior art and none of the present covers satisfy the objects listed herein below.

SUMMARY OF THE INVENTION

It is an object of the present invention to provide a ground cover, suitable for persons to sit or lie on, providing protection between them and the ground.

It is a particular object of the present invention to provide a cover with the ultimate in comfort with ease of portability.

It is a further objection of the present invention to provide a cover as above wherein weights are fixed at the corners to prevent lifting of the corners by the wind, but yet concealing the weights and cushioning them between two layers of fabric preventing harsh contact and possible injury resulting by careless use of the cover.

It is a further object of the present invention to provide a cover wherein a protected pocket is concealed between the two fabric layers being out of sight and difficult to locate.

It is a further object of the present invention to provide a cover with multiple layers, each with absolute compatibility wherein they will shrink and wear cooperatively, prolonging the life of the cover.

It is a particular object of the present invention to provide a cover that will provide the ultimate in comfort, particularly with relation to moisture. It is an object of this invention to provide a cover that will absorb moisture from the body and yet provide a reasonable degree of moisture protection from absorption from the ground below and yet through its construction, dissipate the moisture and prevent its collection between the body and the cover, regardless of the source of the moisture.

It is a particular object of the present invention to provide a cover that is durable and not easily torn or ripped, despite rugged use on sharp or unyielding terrain.

It is another object of the present invention to provide a cover that provides protection from moisture from the grounds but yet also resists attracting sand and dirt to the bottom surface.

It is a particular object of the present invention to provide a cover that provides a cushioned layered structure with an essentially non-slip surface ideal for use on hard surfaces such as the ceramic or the tile around swimming pools or on hard rock surfaces near beaches.

It is a particular object of the present invention to provide a breathable cover that will not attract moisture between the ground and the cover and between the reclining person and the cover.

It is an additional object of the present invention to provide a cover that is suitable not only for warm weather use but is also effective as a cover over the person acting as a comforter or a blanket during cooler weather or during the evenings.

This invention is a ground cover, also referred to as a coverlet, suitable for use by persons sitting or lying on the cover which is placed directly on the ground. It is particularly useful at beaches and on picnics where protection is necessary and comfort is important. An important element of this invention is a two ply cloth construction including a cotton terry cloth top ply and a cotton twill cloth bottom ply. It is preferred that both plies be 100% cotton. Weights, preferably metal weights and more preferably lead weights are fixed at each corner of the cover sandwiched between the two plies. Stitching is used to sew the two plies together to form an integral cover and to fix the weights in each corner. Holes, surrounded by grommets are positioned proximate to each corner and are preferably positioned about one-half to two inches from the corner. A pocket including a waterproof fabric pouch opens at an edge of the cover to the space between the two plies. A fabric hook and eye closure, marketed under the trademark VELCRO®, by Velcro USA, Inc., 681 5th Avenue, New York City, N.Y. is used to close the pocket along the edge of the cover. It is preferred that the VELCRO strips be along the entire length of the pocket opening along the edge of the cover. At least one clip device is included to detachably connect a hole in the cover to a hole in an adjacent cover placed next to it in the ground.

It is preferred that a waterproof bag be provided of a size that the cover can be folded up and fit easily inside including a draw string closure of the bag, a carry strap attached to the top and side of the bag of a length to be slung over a person's shoulder and a patch pocket on the outside of the bag with a VELCRO closure.

While two ply fabric covers have been used for certain applications, such as covers for fenders of automobiles to protect the fenders from mechanics dirt and abrasion of the surface, those constructions are insufficient and unsatisfactory for use by a person as a ground cover. A ply of terry cloth coupled with a ply of impervious material, such as plasticized polyvinyl chloride and other like materials are unsatisfactory for use as a ground cover. While the impervious layer will prevent moisture from reaching the terry cloth from below, moisture collects on the bottom of the vinyl surface. The moisture collects dirt and is unsatisfactory when the cover is picked up to be stored away. Further, the impervious layer provides a distinct lack of comfort to the person lying on the terry cloth side of such a structure. The impervious layer again tends to collect moisture between the terry cloth and the person quickly making the surface very uncomfortable. The combination fabric layers of the invention as above, on the other hand, provides an unusual degree of comfort providing a balance of absorption and of moisture dissipation where under most circumstances. Resting on the cover remains comfortable for long periods of time. Thus, sunbathing on the beach or lying at a picnic is now an even more comfortable diversion. Further, even with this very important advantage, the other objects noted above are attained and satisfied.

It is further found that a person resting on the cover of the present invention with a wet bathing suit allows the upper terry cloth layer to absorb the moisture drawing it away from the body. Further, perspiration from the body or moisture from a recent swim is quickly absorbed into the terry cloth layer. The moisture, on the other hand, does not remain entirely in the terry cloth layer but is dissipated between the layers and to the lower layer further assisting in the evaporation process. Surprisingly, the moisture attracted by the lower layer dissipates sufficiently that it does not attract substantial sand or dirt to the lower surface. The structure of the twill fabric further essentially prohibits invasion of the sand or dirt particles into the interior of the structure between the plies. Even two layers of terry cloth forming a two ply structure do not attain the advantages and results described hereinabove.

While many of the uses and advantages described for the present invention involve going to the beach or around some body of water, it should be understood that many of the advantages and objects of the present invention involve uses and needs that it do not involve water or at least those uses not directly involving swimming or getting the body wet before lying on the ground cover. These uses include but are not limited to camping, picnics, sunbathing in the yard, and any other outdoor activity including the use of the cover as a comforter or blanket during the winter months, whether used indoors or outdoors.

DESCRIPTION OF PREFERRED EMBODIMENTS

Figure 1:
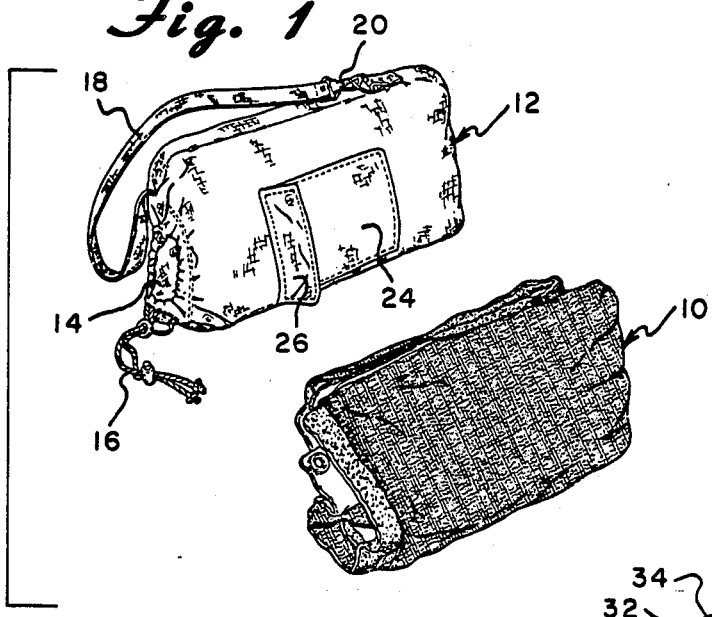
FIG. 1 is a perspective view of a cover of the present invention folded up and exploded out of a carrying bag of the present invention.
Figure 2:
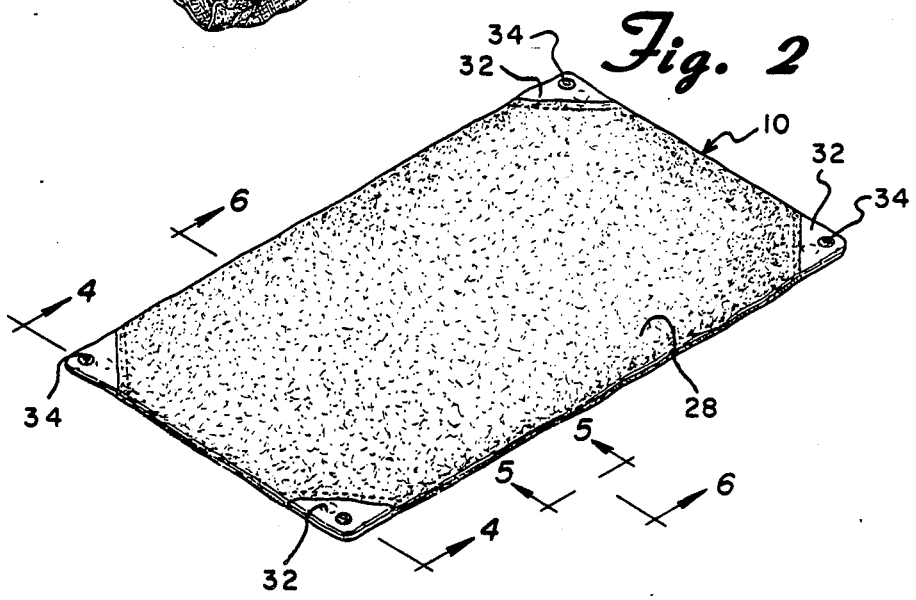
FIG. 2 is a perspective view of the cover of the present invention with the terry cloth side up.
Figure 3:
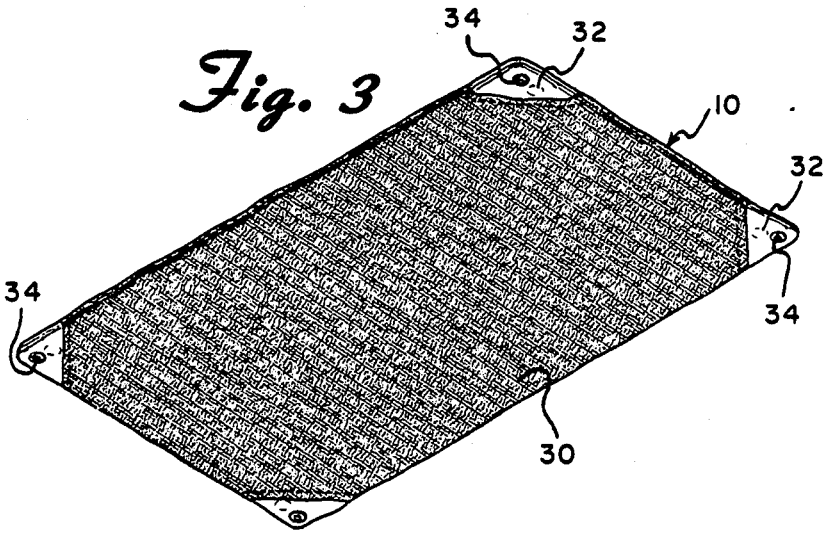
FIG. 3 is a perspective view of the cover of the present invention with the cotton twill layer facing upwardly.
Figure 4:
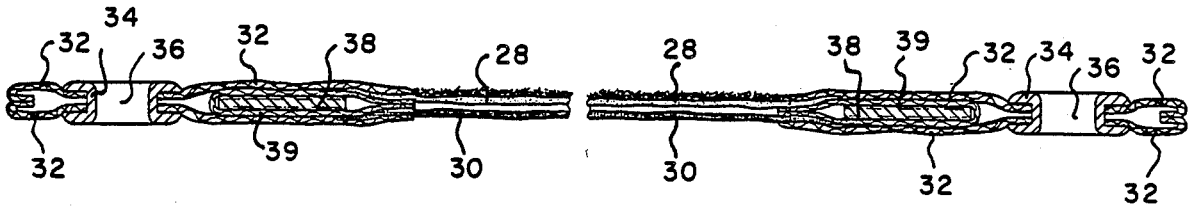
FIG. 4 is a partial expanded cross-sectional view taken along line 4—4 FIG. 2.

In FIG. 1, cover 10 is folded into a package sufficiently small to be inserted in bag 12 constructed of waterproof material, such as fabric reinforced plasticized polyvinyl chloride film or like material constructed in the shape of a bag with opening 14 closed with draw string 16 threaded around and allowed to pull free except for an attachment at the middle to close the bag. Carry strap 18 is attached permanently at the opening top of bag 12 near opening 14 with the other end of strap 18 connected through snap spring clip 20 to a ring permenantly fixed to the side of bag 12 near the opposite closed end of bag 12. Pocket 24 is constructed as a patch pocket sewn on the side of bag 12 approximately in the middle with flap 26 extending over the pocket opening and fixed with VELCRO connectors to close the pocket. As further illustrated in FIGS. 2 and 3, cover 10 is constructed of two plies, the top fabric ply being of 100% cotton terry cloth 12 ounce weight. It is preferred that the weight of the terry cloth be in the range of 7 to 14 ounce weight and more preferred in the range of 10 to 14 ounce weight. Fabric weight is given in ounces, that being the weight of a lineal yard of the fabric with a 45 inch width. The terry cloth may be patterned, but it is preferred to be a solid color and is preferred to be white. The bottom surface, as illustrated in FIG. 3, is a fabric ply of 100% cotton twill cloth having a weight of 8 ounces. It is preferred that the cotton twill cloth be in the weight of 5 to 14 ounces and more preferably in the range of 7 to 12 ounces. It is further preferred that the color be a dark solid color and most preferably dark blue. In each corner, reinforcement of 200 denier waterproof oxford nylon cloth is sewn in a triangular piece to cover the corners and reinforce them in high wear areas. The stitching is provided along each edge sewing the two plies together as well as sewing the corner reinforcements 32 in place. Grommets 34 reinforce holes proximate to each corner and are preferably positioned in the range of one-half to two inches from the corners. The combination of 12 ounce terry cloth and 8 ounce twill cloth provides a most effective barrier against moisture as well as an absorbent construction to absorb body or swim suit moisture without sacrificing comfort. This combination and construction attains the objects described above and attains the balance of characteristics not achieved with other constructions. In FIG. 4, the cross-sectional view illustrates the construction of cover 10 wherein terry cloth ply 28 and twill cloth ply 30 extend all the way to the corners and are reinforced with corner swatches 32 of nylon cloth. Grommets 34 reinforce holes 36 and lead disc weights 38 are sandwiched between plies 28 and 30, held in position by a sewing stitch and further protected by corner reinforcement plies 32. Lead weights 38 are about one-eighth inch thick and weigh one to two ounces.

Figure 5:
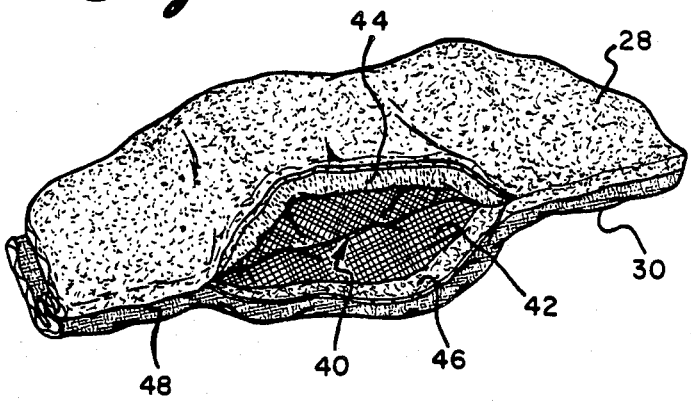
FIG. 5 is a perspective view of a hidden pocket opened to illustrate interior of the pocket positioned along the edge of the cover view along line 5—5 of FIG. 2.
Figure 6:
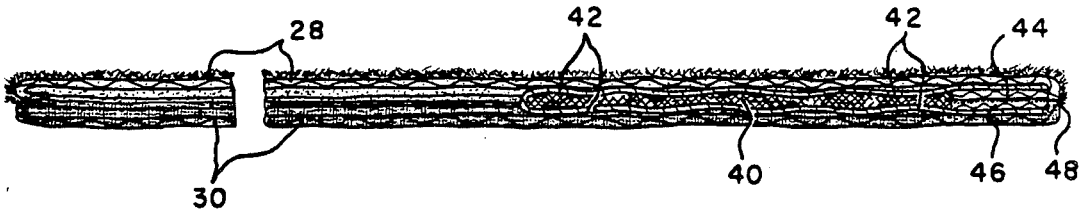
FIG. 6 is a partial cross-sectional view taken along line 6—6 of FIG. 2.
Figure 7:
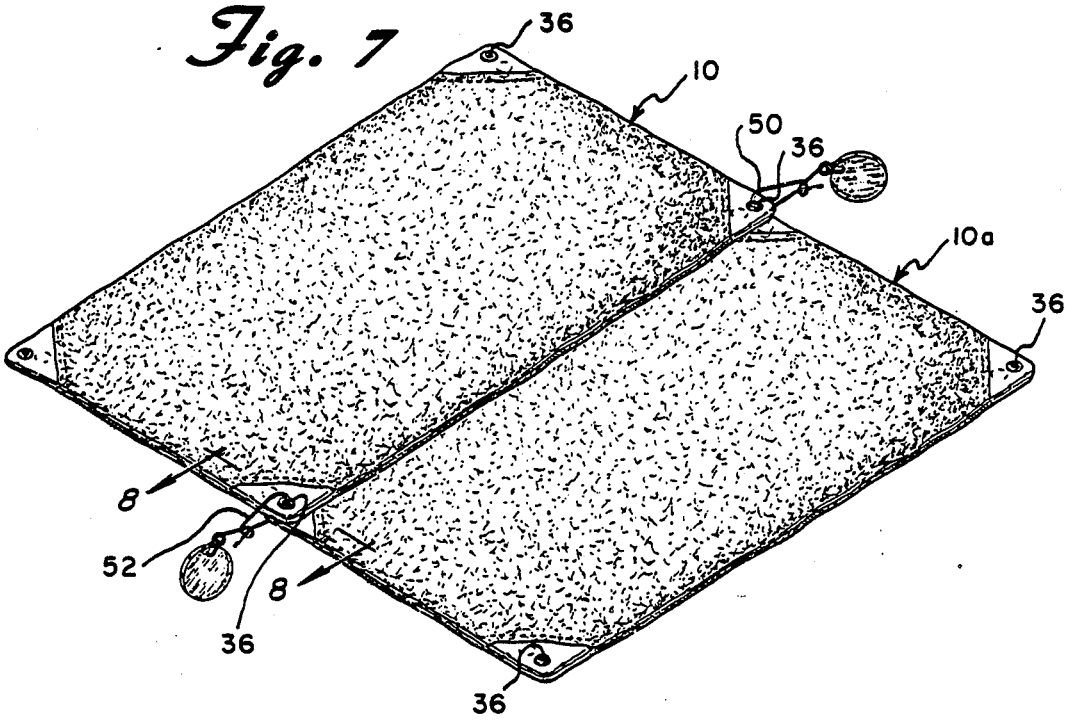
FIG. 7 is a perspective view of two covers as illustrated in FIG. 2 coupled together with clips to form a combined larger ground cover.
Figure 8:
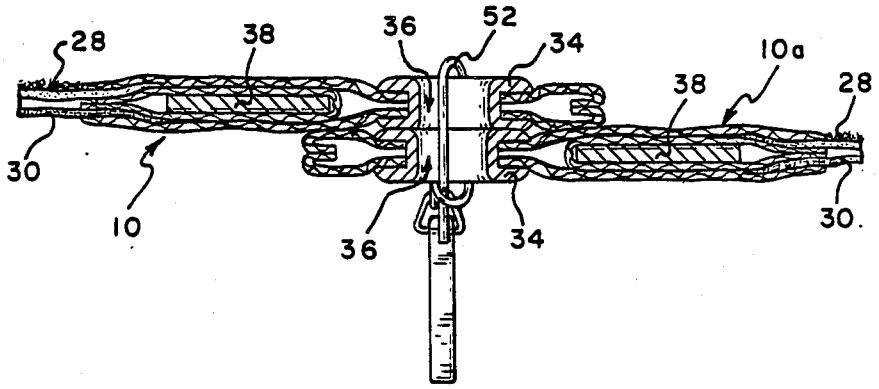
FIG. 8 is a partial cross-sectional view taken along line 8—8 of FIG. 7.
Figure 9:
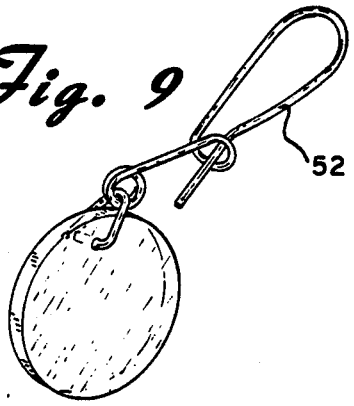
FIG. 9 is a perspective view of the clip used in FIGS. 7 and 8 to hold covers together at the corners.

In FIG. 5, pocket 40 has been opened to display a portion of its interior constructed of waterproof cloth 42, preferably fabric reinforced plasticized polyvinyl chloride film and more preferably 200 denier oxford nylon cloth. Pocket 40 is constructed between plies 28 and 30 and sewn with its opening toward edge 48. VELCRO closures, fabric hook and eye fastening systems marketed under the trademark VELCRO® by Velcro USA, Inc. 681 5th Avenue, New York City, N.Y. are sewn in place as continuous strips along edge 40 to close pocket 40. "Hook" tape 44 engages "eye" tape 46 to provide an invisible but easily openable pocket. As further illustrated in FIG. 6, pocket 40 is constructed of a continuous ply of waterproof cloth 42 sandwiched between fabric plies 28 and 30 closed by VELCRO closures 44 and 46 along edge 48. In FIG. 7, cover 10 is shown lying on the ground next to identical cover 10A. Overlapped as shown, covers 10 and 10A are connected using spring clip 50 on the top and spring clip 52 on the bottom. Thus, with at least one spring clip supplied with each cover 10, combinations with identical covers will form a large area for cooperative enjoyment on the ground. Covers 10 and 10A may be joined side by side as illustrated in FIG. 7 or may be joined end to end using the adjoining holes 36 and the two clips. Further, if a third cover 10 is added, it may be joined again side by side or may be joined end to end with one of the covers to form a variety of patterns. Engagement and connection of two covers is illustrated in the cross-sectional view of FIG. 8 wherein clip 52 joins two covers through holes 36 reinforced by grommets 34. FIG. 9 is an expanded view of a suitable clip connect blankets 10 and 10A together through holes 36.

In order to illustrate the advantages of this invention, a coverlet was constructed according to that illustrated in FIGS. 1 through 6. A second coverlet is constructed of two plies of terry cloth, each ply being 12 ounces weight. A third coverlet is constructed of a single ply of terry cloth 12 ounces in weight sandwiched to a second ply of fabric reinforced plasticized polyvinyl chloride film of fifteen mil thickness. The vinyl film is plasticized according to upholstery standards and is constructed to have the softest "feel" available from this type of material. The three coverlets are stretched on the ground first on sand near the ocean and then on good quality grass cover, typical of that around residential home. After sitting on the ground unattended for about one hour, the third coverlet accumulates a substantial amount of moisture on the bottom attracting bits and pieces of the ground as well as a number of insects on the grass covered ground. The first and second covers are dry on the bottom. Next, each of the covers are subjected to three persons sitting and lying on the coverlets in wet bathing suits. Only the first coverlet of the present invention provides total comfort. The second coverlet immediately soaks through directly to the ground, picking up sand from the beach and vegetable matter and dirt from the lawn location. The person sitting on the third coverlet is very uncomfortable from a heat accumulation wherever the coverlet is rested upon. Further, the plies of the third coverlet tend to slide against each other providing substantial discomfort and difficulty in getting comfortable. The plies of the second coverlet become "melded" together by the accumulated dampness to form substantial discomfort under the person. When the coverlets are lifted after use, only the first coverlet is essentially clean and ready to be moved from the scene without substantial cleaning.

While this invention has been described with reference to the specific embodiments disclosed herein, it is not confined to the details set forth and the patent is intended to include modifications and changes which may come within and extend from the following claims.

I claim:

1. A ground cover suitable for a person or persons to sit on or lie on placed directly on the ground comprising:

(a) a two ply cloth cover comprising:
  (i) a cotton terry cloth top ply, wherein the terry cloth is sufficiently absorptive of moisture to absorb water from the person's body, and
  (ii) a cotton twill cloth bottom ply, wherein the twill cloth is sufficiently pervious to moisture to allow moisture from the terry cloth ply to permeate into and through the twill ply,
(b) a metal weight at each corner of the cover positioned between the two plies,
(c) stitching means to sew the two plies together to form an integral cover and fix the weights at the corners and corner reinforcement panels attached to the top and bottom plies.

2. The cover of claim 1 further comprising:

(a) grommet surrounded holes proximate to each corner, and
(b) at least one clip means to detachably connect a hole in the cover to a hole in an adjacent cover.

3. The cover of claim 2 wherein a waterproof nylon cloth cOrner reinforcemnt panel is stitchably attached at the corner sandwiching the two ply cover between plies of the nylon.

4. The cover of claim 1 wherein a waterproof bag is provided of a size to enclose the cover comprising:

(a) a draw string closure of the bag,
(b) a carry strap attached to the top and side of the bag of a length to be slung over a person's shoulder, and
(c) a patch pocket on the outside of the bag with fabric hook and eye closure.

5. The cover of claim 1 further comprising:

(a) a pocket opening at the edge of the cover opening to a space between the two plies, and (b) a waterproof fabric pocket disposed between the two plies with a fabric hook and eye closure to close the pocket along the edge of the cover.

6. A ground cover suitable for a person or persons to sit on or lie on placed directly on the ground comprising:

(a) a two ply cloth cover comprising:
(i) a cotton terry cloth top ply, and
(ii) a cotton twill cloth bottom ply,
(b) a metal weight at each corner of the cover positioned between the two plies,
(c) stitching means to sew the two plies together to form an integral cover and fix the weights at the corners,
(d) grommet surrounded holes proximate to each corner,
(e) a pocket opening at the edge of the cover opening to a space between the two plies,
(f) a waterproof fabric pocket disposed between the two plies with a fabric hook and eye closure to close the pocket along the edge of the cover, and
(g) at least one clip means to detachably connect a hole in the cover to a hole in an adjacent cover.

7. The cover of claim 6 wherein a waterproof nylon cloth corner reinforcement panel is stitchably attached at the corner sandwiching the two ply cover between plies of the nylon.

8. A ground cover suitable for a person or persons to sit on or lie on placed directly on the ground comprising:

(a) a two ply cloth cover comprising:
(i) a cotton terry cloth top ply, wherein the terry cloth is sufficiently absorption of moisture to absorb water from the person's body, and
(ii) a cotton twill cloth bottom ply, wherein the twill cloth is sufficiently pervious to moisture to allow moisture from the terry cloth ply to permeate into and through the twill ply,
(b) a metal weight at each corner of the cover positioned between the two plies,
(c) stitching means to sew the two plies together to form an integral cover and fix the weights at the corners,
(d) a pocket opening at the edge of the cover opening to a space between the two plies,
(e) a waterproof fabric pocket disposed between the two plies with a fabric hook and eye closure to close the pocket along the edge of the cover and corner reinforcement panels attached to the top and bottom plies.

* * * * *